US005715568A

United States Patent [19]

Berfield et al.

[11] Patent Number: 5,715,568

[45] Date of Patent: Feb. 10, 1998

[54] VACUUM APPARATUS HAVING A PUMP FOR DISCHARGING LIQUID THEREFROM

[75] Inventors: Robert C. Berfield, Jersey Shore; Craig A. Seasholtz, Avis, both of Pa.

[73] Assignee: Shop Vac Corporation, Williamsport, Pa.

[21] Appl. No.: 570,979

[22] Filed: Dec. 12, 1995

[51] Int. Cl.[6] ..... A47L 7/00

[52] U.S. Cl. ..... 15/353; 15/321; 15/327.1; 55/430

[58] Field of Search ..... 15/353, 321, 327.1, 15/327.6; 55/430

[56] References Cited

U.S. PATENT DOCUMENTS

| | | | |
|---|---|---|---|
| 1,675,199 | 6/1928 | Smith . | |
| 2,049,603 | 8/1936 | Dietenberger . | |
| 2,312,526 | 3/1943 | Curtis . | |
| 2,320,708 | 6/1943 | Yost . | |
| 2,623,234 | 12/1952 | Brown . | |
| 2,643,732 | 6/1953 | Keen . | |
| 2,747,513 | 5/1956 | Atkinson . | |
| 2,932,844 | 4/1960 | O'Connor | 15/321 |
| 2,965,038 | 12/1960 | Purden et al. . | |
| 3,090,318 | 5/1963 | Jeep, Jr. et al. . | |
| 3,238,556 | 3/1966 | Martin . | |
| 3,327,144 | 6/1967 | Double . | |
| 3,332,101 | 7/1967 | Leinfelt et al. . | |
| 3,605,786 | 9/1971 | Machin, Jr. . | |
| 3,736,548 | 5/1973 | Double . | |
| 3,747,155 | 7/1973 | Koellisch | 15/321 X |
| 3,754,844 | 8/1973 | Nusser et al. . | |
| 3,774,260 | 11/1973 | Emus | 15/353 X |
| 3,940,826 | 3/1976 | Phillips et al. | 15/353 X |
| 4,021,144 | 5/1977 | Matsusaka . | |
| 4,041,569 | 8/1977 | Petersen . | |
| 4,080,104 | 3/1978 | Brown, Jr. . | |
| 4,134,174 | 1/1979 | Flynn et al. | 15/353 X |
| 4,137,599 | 2/1979 | Steyer . | |
| 4,138,761 | 2/1979 | Nauta . | |
| 4,171,208 | 10/1979 | Lowder . | |
| 4,179,768 | 12/1979 | Sawyer . | |
| 4,246,676 | 1/1981 | Hallsworth et al. | 15/353 |
| 4,325,163 | 4/1982 | Mattson et al. . | |
| 4,378,611 | 4/1983 | Ninehouser | 15/353 |
| 4,723,337 | 2/1988 | Ellison et al. | 15/353 X |
| 4,800,612 | 1/1989 | Valentine . | |
| 4,800,613 | 1/1989 | Blase et al. . | |
| 4,809,396 | 3/1989 | Houser | 15/353 X |
| 4,810,169 | 3/1989 | Kranzle . | |
| 4,827,562 | 5/1989 | Blase et al. . | |
| 4,836,753 | 6/1989 | Berfield et al. . | |
| 4,841,595 | 6/1989 | Wiese . | |
| 4,844,705 | 7/1989 | Gannaway . | |

(List continued on next page.)

FOREIGN PATENT DOCUMENTS

| | | |
|---|---|---|
| 1-142221 | 3/1957 | France . |
| 2 484 558 | 12/1981 | France . |
| 3-64661 | 3/1991 | Japan . |
| 6-10895(A) | 1/1994 | Japan . |

OTHER PUBLICATIONS

"Industrial Maintenance & Plant Operation's Buyer's Guide to Pumps", pp. 26–27, 52–53, undated.

"Little Giant Water Wizard Submersible Utility Pump Owners Manual", Jan. 1988, (4 pages).

1980 Grainger "Wholesale Met Price Motorbook Catalog", No. 356, Spring 1980, (2 pages).

*Primary Examiner*—Chris K. Moore

*Attorney, Agent, or Firm*—Marshall, O'Toole, Gerstein, Murray & Borun

[57] ABSTRACT

A vacuum apparatus includes a holding tank, a vacuum source, and a docking station. The tank holds material and has an interior and an exterior. The vacuum source draws the material from the exterior into the interior of the tank. The docking station docks a pump on the exterior of the tank so that, when the pump is docked in the docking station, the pump may be used to pump material out of the tank and so that the pump may be detached from the docking station for stand alone use.

42 Claims, 10 Drawing Sheets

U.S. PATENT DOCUMENTS

| | | | |
|---|---|---|---|
| 4,847,943 | 7/1989 | Blase et al. . | |
| 4,854,544 | 8/1989 | Blase et al. . | |
| 4,862,026 | 8/1989 | Riback . | |
| 4,864,680 | 9/1989 | Blase et al. . | |
| 4,934,017 | 6/1990 | Kent . | |
| 4,961,018 | 10/1990 | Akhter . | |
| 4,976,850 | 12/1990 | Kulitz . | |
| 5,048,148 | 9/1991 | Gleadall . | |
| 5,086,537 | 2/1992 | McDowell et al. . | |
| 5,087,018 | 2/1992 | Blase et al. . | |
| 5,125,126 | 6/1992 | Bonnant . | |
| 5,146,647 | 9/1992 | Blase et al. . | |
| 5,178,823 | 1/1993 | Hughes | 15/353 X |
| 5,181,838 | 1/1993 | Sato et al. . | |
| 5,182,834 | 2/1993 | Wright et al. . | |
| 5,207,562 | 5/1993 | Neibrook et al. . | |
| 5,237,720 | 8/1993 | Blase et al. . | |
| 5,263,225 | 11/1993 | Winters . | |
| 5,289,611 | 3/1994 | Yonkers et al. . | |
| 5,309,600 | 5/1994 | Weaver et al. . | |
| 5,349,722 | 9/1994 | Chayer | 15/353 |
| 5,378,354 | 1/1995 | Poor | 15/353 X |
| 5,386,612 | 2/1995 | Sham . | |
| 5,398,373 | 3/1995 | Blase et al. . | |
| 5,400,543 | 3/1995 | Ideker, Jr. . | |
| 5,455,984 | 10/1995 | Blase . | |
| 5,459,901 | 10/1995 | Blase et al. . | |
| 5,465,455 | 11/1995 | Allen . | |
| 5,483,726 | 1/1996 | Blase et al. . | |
| 5,555,597 | 9/1996 | Berfield | 15/353 X |
| 5,560,075 | 10/1996 | Jankowski | 15/353 X |

VACUUM APPARATUS HAVING A PUMP FOR DISCHARGING LIQUID THEREFROM

FIELD OF THE INVENTION

The present invention relates to a vacuum apparatus having a pump for discharging liquid from a holding tank of the vacuum apparatus.

BACKGROUND OF THE INVENTION

A wet/dry vacuum apparatus typically includes, for example, a motor housing, a lid cage, and a tank. The motor housing houses a motor which drives an impeller. The impeller creates a vacuum which draws air, as well as solid and/or liquid material, through a nozzle attachment into the vacuum apparatus. During dry operation, the vacuum apparatus has a filter installed in such a manner that it filters larger objects out of the air drawn into the vacuum apparatus in reaction to the vacuum created by the impeller. The tank holds these larger objects which are filtered out of the air by the filter. The air which passes through the filter is exhausted from the vacuum apparatus through an exhaust opening. When the larger objects are to be removed from the tank, the motor housing and lid cage are removed, and the tank is normally inverted in order to dump out the larger objects.

During wet operation, the filter may or may not be removed from the vacuum apparatus. The vacuum created by the impeller driven by the motor causes liquid to be drawn into the tank through the inlet nozzle. Because the liquid is heavier than air, the liquid settles into the tank and is not exhausted through the exhaust opening. When the liquid is to be removed from the tank, either a valve near the bottom of the tank is opened in order to drain the liquid from the tank, or the motor and lid cage are removed and the tank is tilted to dump out the liquid.

A wet/dry vacuum apparatus, such as that described above, is particularly useful to vacuum up liquid spills, overflows, and the like where the amount of liquid is relatively small. However, for large amounts of liquid, such as may be caused by flooding, a pump is more often preferred in order to pump the liquid from the flooded area to a drain or runoff. The present invention is directed to a vacuum apparatus which is useful in removing both small and large amounts of liquid from a wet area. In accordance with an embodiment of the present invention, a vacuum apparatus has a docking station for a pump. When the pump is in the docking station, the pump has access to the tank of the vacuum apparatus so that the vacuum apparatus may be used to vacuum up liquid from a wet area and so that the pump may be used to pump this liquid from the tank of the vacuum apparatus to an area, such as a drain or runoff, which is external to the vacuum apparatus. If a large amount of liquid must be removed from a wet area, the pump may be removed from the docking station, and the pump may be used to pump this liquid from the wet area, which is external to the vacuum apparatus, to a discharge area, such as a drain or runoff area.

SUMMARY OF THE INVENTION

Therefore, in accordance with one aspect of the present invention, a vacuum apparatus comprises holding means, drawing means, and a docking station. The holding means holds material and has an opening, an interior, and an exterior. The drawing means draws the material from the exterior into the interior of the holding means. The docking station is in the exterior of the holding means, and the docking station defines a pump area in which a pump is received so that, when the pump is docked at the docking station, the pump may be used to pump material out of the holding means through the opening and the pump may be detached from the docking station.

In accordance with another aspect of the present invention, a vacuum apparatus comprises a holding tank, a source of vacuum, and a submersible pump. The holding tank has an opening, an interior, and an exterior. The source of vacuum is arranged to draw material from the exterior into the interior of the holding tank. The submersible pump is mounted to the exterior of the holding tank and is arranged to discharge the material through the opening from the interior to the exterior of the holding tank.

In accordance with yet another aspect of the present invention, a vacuum apparatus comprises a holding tank, a source of vacuum, and a pump. The holding tank has an opening, an interior, and an exterior. The source of vacuum is arranged to draw material from the exterior into the interior of the holding tank.

The pump is mounted with a quick connect to the holding tank and is arranged to discharge the material from the interior through the opening to the exterior of the holding tank.

BRIEF DESCRIPTION OF THE DRAWINGS

These and other features and advantages will become more apparent from a detailed consideration of the invention when taken in conjunction with the drawings in which.

DETAILED DESCRIPTION OF THE INVENTION

Figure 1:
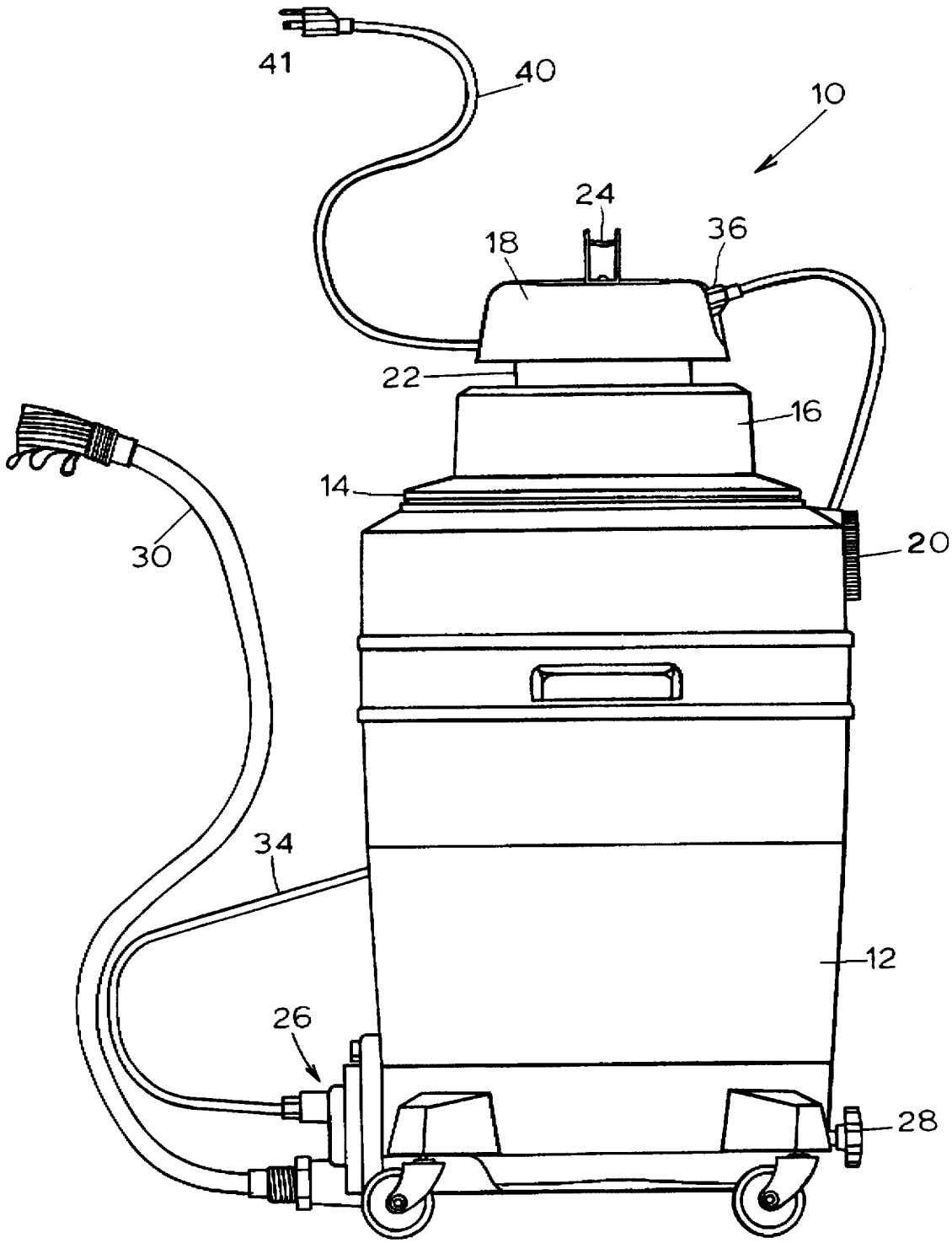
FIG. 1 is a side view of a vacuum apparatus having a pump docked thereon in accordance with the present invention.
Figure 2:
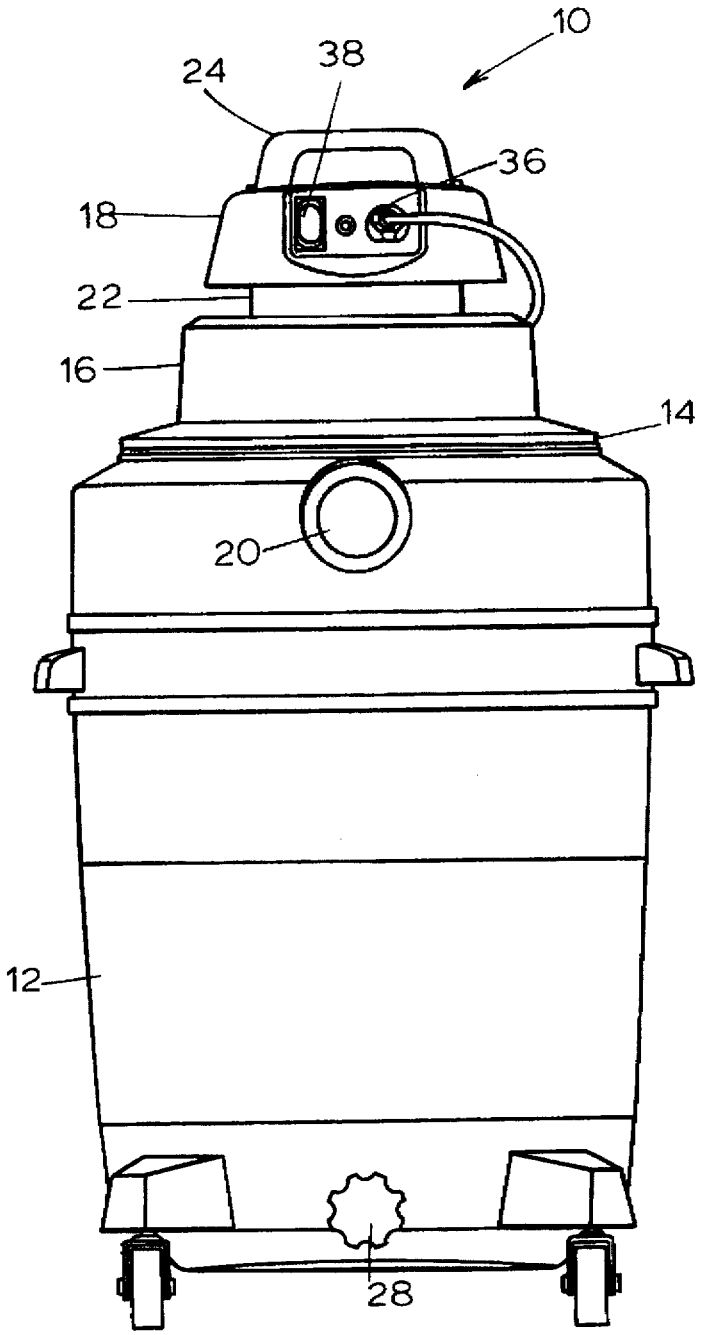
FIG. 2 is front view of the vacuum apparatus shown in FIG. 1.

As shown in FIGS. 1 and 2, a vacuum apparatus 10, such as a wet/dry vacuum cleaner, includes a tank 12, a lid cage 14, a motor housing 16, and a cover 18. The tank 12, the lid cage 14, the motor housing 16, and the cover 18 may each be formed wholly or partially of molded plastic or may be formed of any other suitable material. The motor housing 16 houses a motor which drives an impeller. The impeller is arranged to create a vacuum within the vacuum apparatus 10. The vacuum apparatus 10 has a vacuum inlet 20 and a vacuum outlet 22. The vacuum created by the impeller driven by the motor housed in the motor housing 16 draws air and solid and/or liquid material through the vacuum inlet 20 and into the vacuum apparatus 10, and the vacuum outlet 22 is arranged to exhaust air from the vacuum apparatus 10. The tank 12 holds the solid and/or liquid material which is vacuumed into the vacuum apparatus 10. A handle 24 may be molded with the cover 18, or the handle 24 may be a separate structure which is suitably fastened to the cover 18.

As shown in FIG. 1, a pump 26 is docked to the tank 12. As discussed more fully hereinafter, a valve operator 28 operates a valve which cooperates with the pump 26 in order to permit communication between the interior of the tank 12 and the pump 26 when the valve operator 28 is in one position and to seal the interior of the tank 12 from the pump 26 when the valve operator 28 is in another position. Accordingly, when the pump 26 is docked to the tank 12, the pump 26 can be used to pump liquid out of the tank 12 through a discharge hose 30.

As shown in FIG. 1, the valve operator 28 is generally aligned vertically with the vacuum inlet 20 and the pump 26 is located approximately 180° around the vacuum apparatus 10 from the operator 28. However, the pump 26 and the valve operator 28 both may be located approximately 90° around the vacuum apparatus 10 from their positions as shown in FIG. 1. Also, a drain could be positioned on the vacuum apparatus 10 at the location where the valve operator 28 is currently shown in FIG. 1. It further should be apparent that the pump 26 and the valve operator 28 may be positioned in any other locations on the vacuum apparatus 10.

Figure 3:
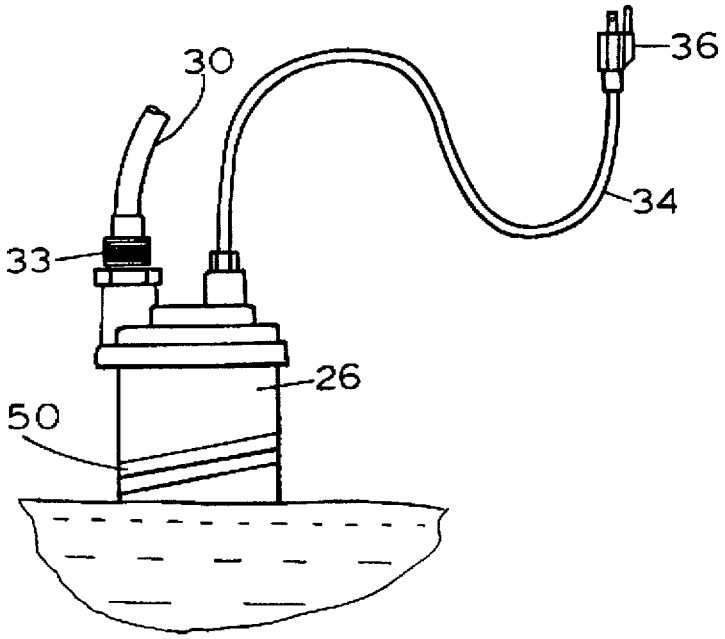
FIG. 3 is a view of the pump which has been detached from the vacuum apparatus shown in FIGS. 1 and 2.

As shown in FIG. 3, the pump 26 may be a submersible pump. When the pump 26 is detached from the vacuum apparatus 10, the pump 26 may be used to pump liquid 32 out of a discharge nozzle 33 and through the discharge hose 30 from a wet area, which is external to the vacuum apparatus 10, to a discharge area, such as a drain or runoff area. The pump 26 also includes a power cord 34 for supplying electrical energy to the motor of the pump 26. The power cord 34 terminates in a three prong plug 36 which may be plugged into a receptacle which is located in the cover 18 or into any other receptacle such as a wall outlet.

The cover 18 also provides access to a switch 38 of the vacuum apparatus 10. A power cord 40 is connected at one end to the vacuum apparatus 10 and has a three prong plug 41 at its other end. The three prong plug 41 at the end of the power cord 40 may be plugged into a receptacle such as a wall outlet. When the three prong plug 41 at the end of the power cord 40 is plugged into a receptacle, power is supplied from that receptacle to the switch 38. The switch 38 of the vacuum apparatus 10 may have three positions. The first position of the switch 38 cuts power from the power cord 40 to both the vacuum motor housed by the motor housing 16 and the pump 26. The second position of the switch 38 supplies power from the power cord 40 to the vacuum motor housed by the motor housing 16 so that solid and/or liquid material may be vacuumed into the vacuum apparatus 10. Accordingly, solid and/or liquid material is vacuumed in through the vacuum inlet 20 and into the tank 12. The third position of the switch 38 is a momentary switch position which supplies power from the power cord 40 to the pump 26 only so long as the operator holds the switch 38 in its third position. Accordingly, the pump 26 is energized so that liquid may be pumped from the tank 12 of the vacuum apparatus 10 to a discharge area, such as a drain or runoff, which is external to the vacuum apparatus 10. Accordingly, liquid is discharged by the pump 26 from the tank 12 through the discharge hose 30. When the operator no longer holds the switch 38 in its third position, the switch 38 automatically returns to its first position and the pump 26 is thereby deenergized. Accordingly, the operator cannot inadvertently leave the pump 26 in unattended operation. Alternatively, the vacuum motor, which is housed by the motor housing 16, and the pump 26 may be controlled by separate switches.

Figure 4:
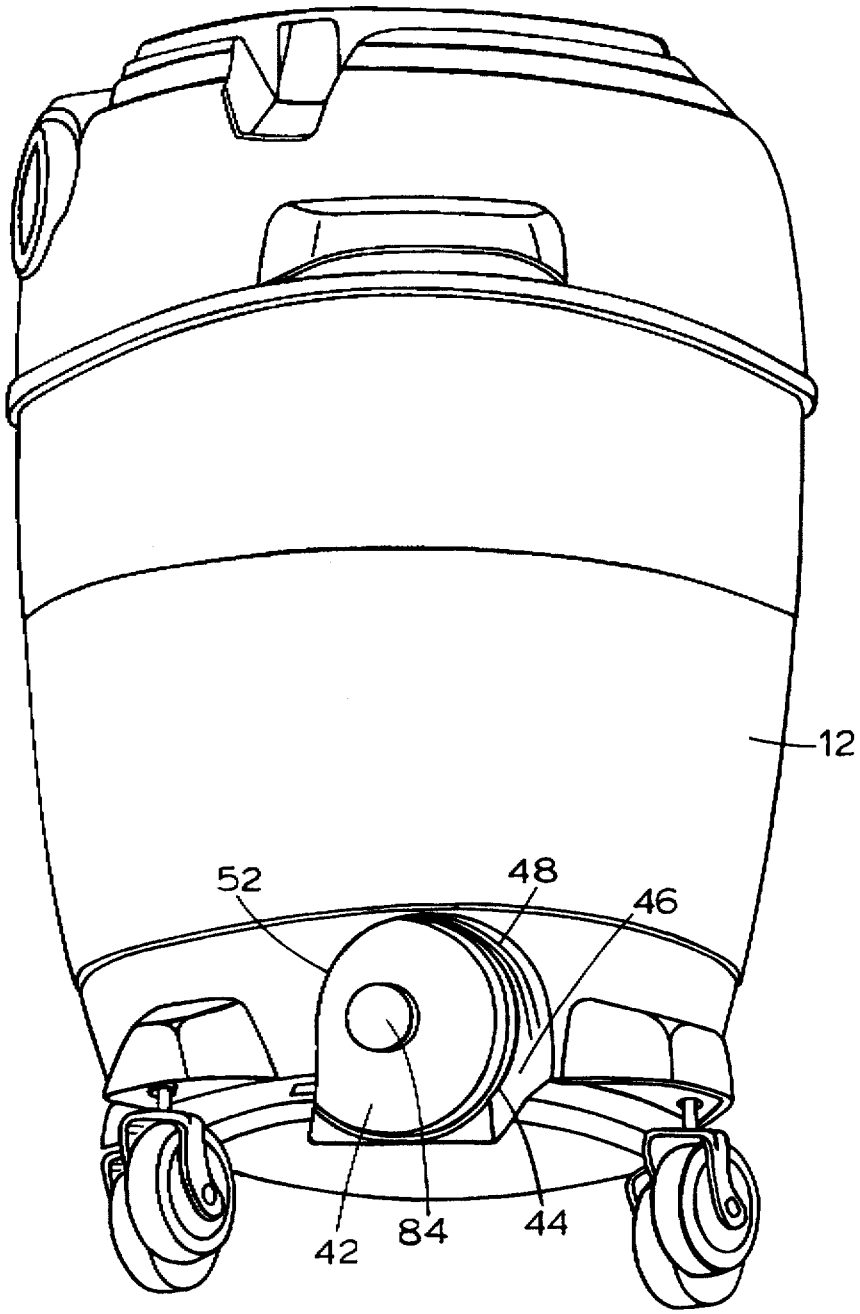
FIG. 4 is a view of the vacuum apparatus of FIGS. 1 and 2 which illustrates the docking station for the pump shown in FIG. 3.
Figure 5:
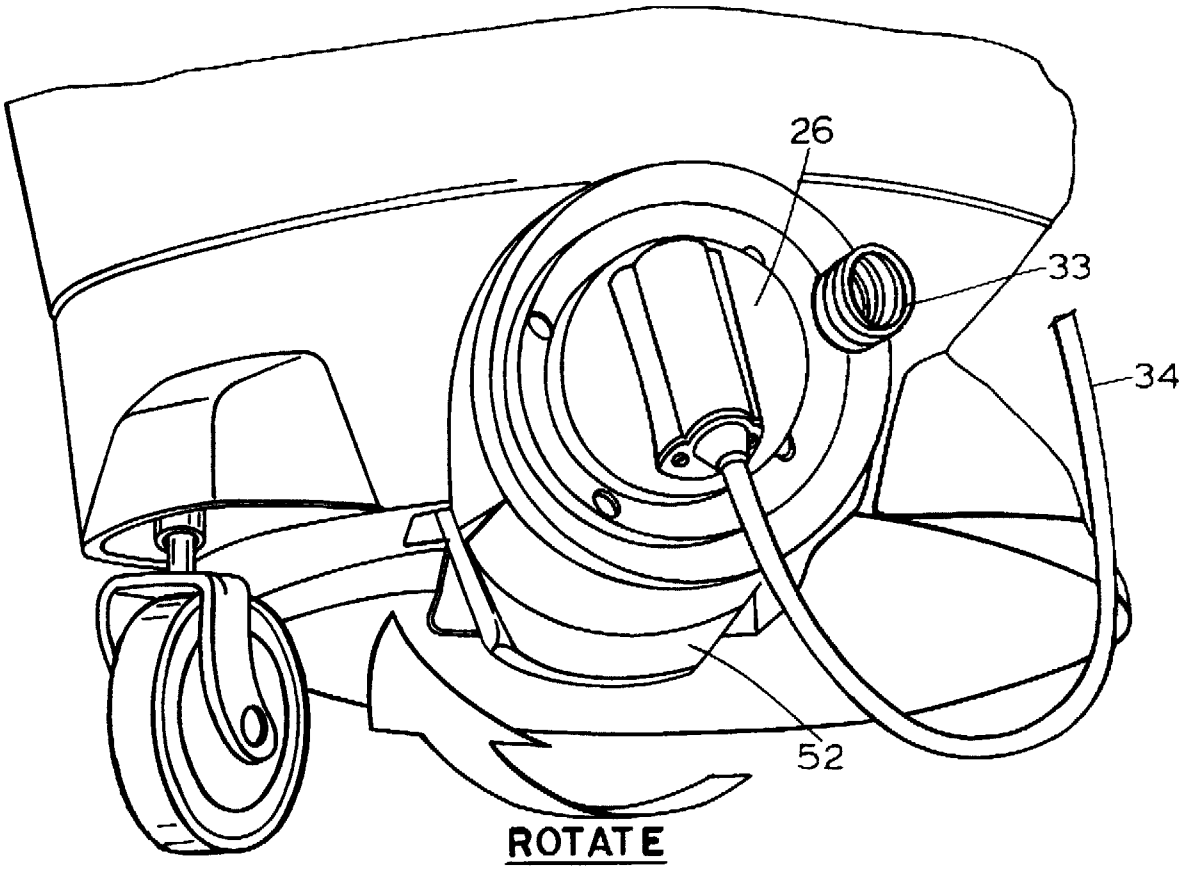
FIG. 5 is a view showing the pump being mounted to the docking station illustrated in FIG. 4.
Figure 7:
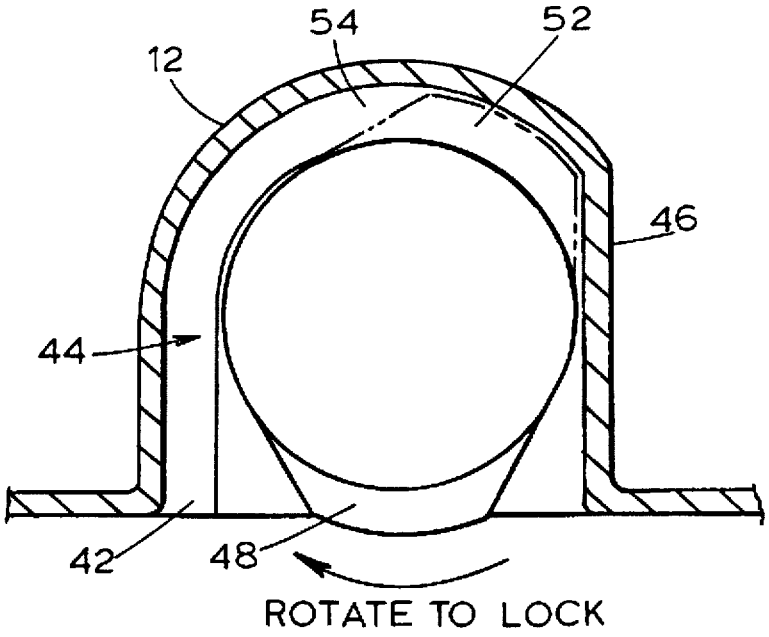
FIG. 7 is a simplified diagram showing the pump of FIG. 3 locked in the docking station illustrated in FIG. 4.
Figure 9:
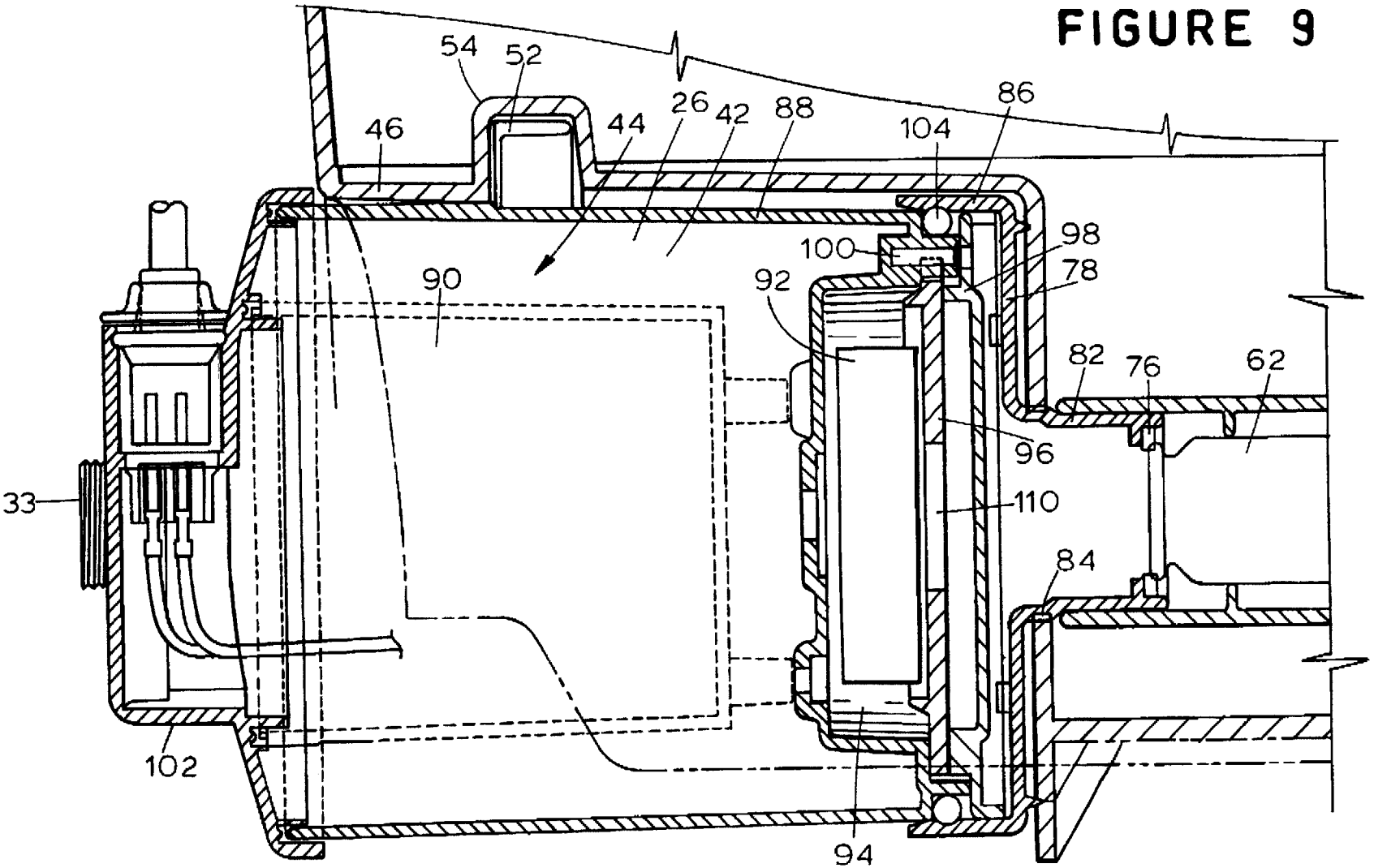
FIGS. 9 and 10 taken together illustrate an enlarged cross-sectional side view of the valve illustrated in FIG. 8 and the pump mounted in the docking station illustrated in FIG. 4.

As shown in FIGS. 4, 7, and 9, the tank 12 includes a docking station 42. The docking station 42 is formed by an external recess 44 in the tank 12. The external recess 44 forms a circumferential docking wall 46. The docking station 42 is dimensioned with respect to an outer dimension of the pump 26 so that a friction fit is provided to hold the pump 26 in the docking station 42.

Figure 6:
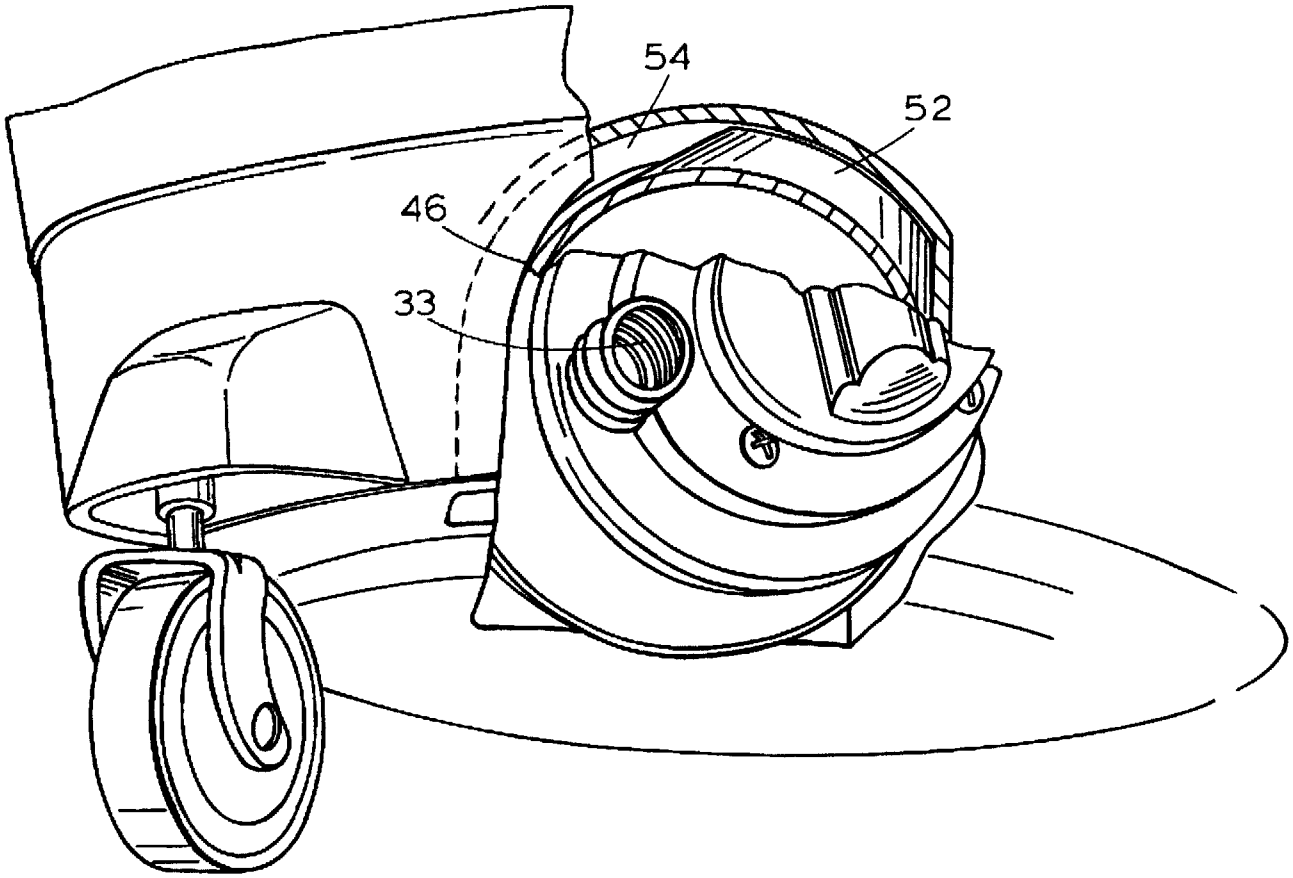
FIG. 6 is a partial cut-away view showing the pump of FIG. 3 mounted to the docking station illustrated in FIG. 4.

Furthermore, as shown in FIGS. 5, 6, 7, and 9, the pump 26 has a pump handle 52. As shown in FIGS. 6, 7, and 9, as the pump 26 is inserted into the docking station 42, the pump 26 is rotated clockwise so that the pump handle 52 is inserted into a cooperating groove 54 which is formed in the circumferential docking wall 46 of the docking station 42 in the tank 12. Accordingly, the pump handle 52, which is captured in the cooperating groove 54 of the circumferential docking wall 46 of the docking station 42, together with the frictional engagement between the pump 26 and the docking station 42, cooperate to secure the pump 26 in the docking station 42. A detent (not shown) may be provided in the cooperating groove 54 which cooperates with the pump handle 52 to inhibit unintended counter-clockwise rotation of the pump handle 52 in the cooperating groove 54.

In order to remove the pump 26 from the tank 12, the power cord 34 is merely unplugged by use of the three prong plug 36 from the receptacle in the cover 18, and the pump 26 is rotated so that the pump handle 52 is rotated out of the cooperating groove 54 in the circumferential docking wall 46 and so that frictional engagement between the pump 26 and the docking station 42 is broken.

Figure 8:
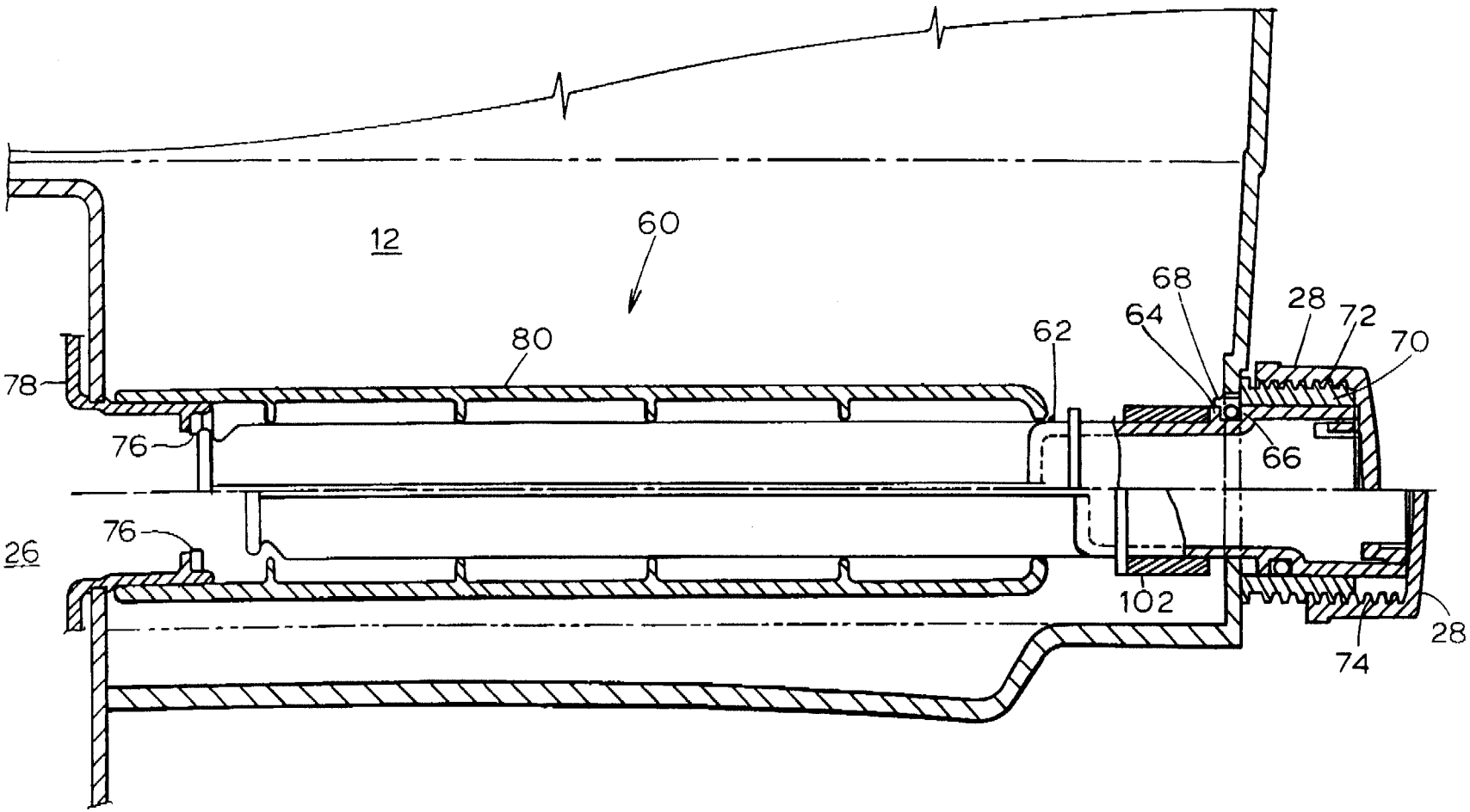
FIG. 8 is a cross-sectional view showing two positions of a valve which extends through a tank of the vacuum apparatus shown in FIGS. 1 and 2 between a manual operator and the docking station illustrated in FIG. 4.

As shown in FIG. 8, a valve 60 extends between the valve operator 28 and the pump 26 in order to control communication between the interior of the tank 12 and the pump 26. The valve operator 28 may be spin welded to a valve stem 62. The valve stem 62 includes a pair of circumferential flanges 64 and 66 which form a seal holder for holding an O-ring seal 68. A fitting 70 is fixedly secured to the tank 12 by any suitable means and has a plurality of threads 72 about an outer surface thereof. The threads 72 cooperate with threads 74 about an inner surface of the valve operator 28. As the valve operator 28 is rotated in a first direction so that the valve operator 28 is increasingly threaded onto the fitting 70, the engagement between the threads 72 and 74 causes the valve stem 62 to be moved toward engagement with a valve seat 76 which is formed by a socket 78 in the docking station 42. When the valve stem 62 engages the valve seat 76, communication between the interior of the tank 12 and the pump 26 is precluded. On the other hand, as the valve operator 28 is rotated in a second direction so that the valve operator 28 is decreasingly threaded onto the fitting 70, the engagement between the threads 72 and 74 causes the valve stem 62 to be moved away from engagement with the valve seat 76. When the valve stem 62 is disengaged from the valve seat 76, communication between the interior of the tank 12 and the pump 26 is permitted.

A tank filter screen 80 surrounds the valve stem 62 in order to filter larger objects from the liquid which flows from the tank 12 to the pump 26 when the valve operator 28 moves the valve stem 62 away from the valve seat 76. The tank filter screen 80 may be a two-part snap-together screen.

The docking station 42, which includes the socket 78, is shown in more detail in FIG. 9. The socket 78 is suitably affixed to the tank 12. For example, the socket 78 may be spin welded to the tank 12. The socket 78 includes a socket neck 82, which extends between a hole 84 in the tank 12, and a pump receiving basin 86.

The pump 26 includes a pump housing 88 which houses a pump motor 90. An impeller 92 is drivingly engaged to the pump motor 90 and is located in a cylindrical recess 94 of the pump housing 88. An inlet plate 96 encloses the impeller 92 within the cylindrical recess 94 of the pump housing 88 and provides an inlet aperture 110. The inlet plate 96 is clamped by an inlet filter screen 98. The inlet filter screen 98 is fixedly attached to the pump housing 88 as by screws 100.

Accordingly, during assembly of the pump 26, the pump motor 90 is placed in the pump housing 88 in the position shown in FIG. 9 and is held therein by a pump housing cover 102. The impeller 92 is attached to the drive shaft of the pump motor 90 so that the impeller 92 is drivingly engaged thereto and so that the impeller 92 is located in the cylindrical recess 94 within the pump housing 88. The inlet filter screen 98 is fixedly attached to the pump housing 88 as by screws 100 so that the inlet filter screen 98 clamps the inlet plate 96 to the pump housing 88 and so that the inlet plate 96 encloses the impeller 92 within the cylindrical recess 94. The pump 26 may then be docked in the docking station 42 by inserting the pump 26 into the external recess 44, and by rotating the pump 26 so that the pump 26 frictionally engages the docking station 42 and so that the pump handle 52 is rotated through the cooperating groove 54 in the circumferential docking wall 46 until the pump 26 is fully seated in the pump receiving basin 86. An O-ring 104 surrounds the pump housing 88 and provides a seal between the pump housing 88 and the socket 78. Accordingly, liquid is prevented from leaking around the pump housing 88.

Figure 10:
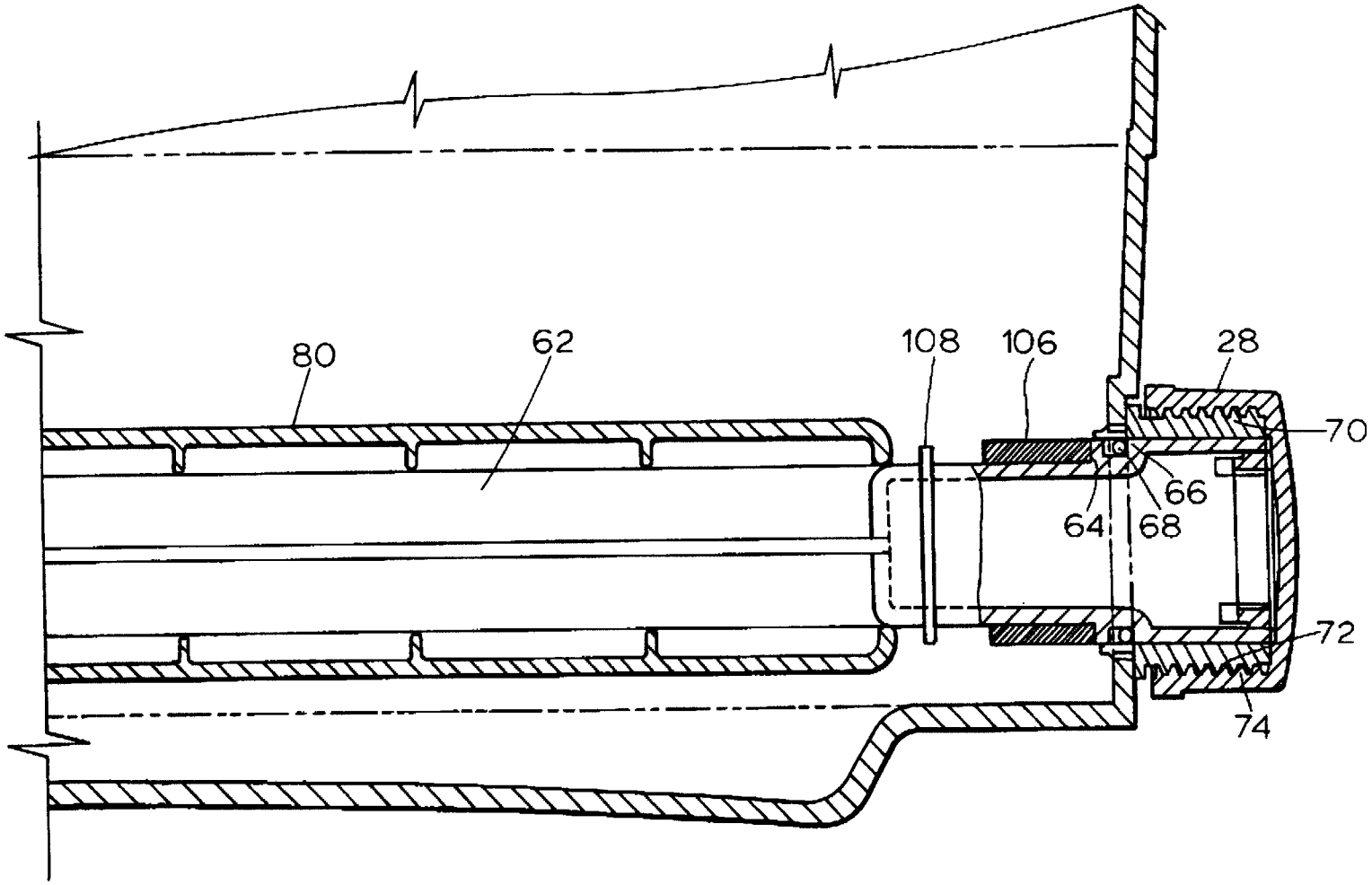

With the pump 26 secured to the docking station 42 of the tank 12, the tank filter screen 80 is snapped together, the valve stem 62 is inserted through the fitting 70 and the tank filter screen 80, and the valve operator 28 is rotated until the valve stem 62 seats against the valve seat 76. A stop clip 106 is clipped over the valve stem 62 in the position shown in FIG. 10. The stop clip 106 has an outer diameter which is greater that the inner diameter of the fitting 70 so that the stop clip 106 is not withdrawn from the tank 12 as the valve stem 62 is moved away from the valve seat 76 by the valve operator 28. A stop 108 on the valve stem 62, in combination with the stop clip 106, limits travel of the valve stem 62 in the open valve direction.

The vacuum apparatus 10 is then ready for use to vacuum solid and/or liquid material into the tank 12. Accordingly, the switch 38 may be operated to its second position in order to supply power to the vacuum motor housed by the motor housing 16 so that the solid and/or liquid material may be vacuumed in through the vacuum inlet 20 and into the tank 12 of the vacuum apparatus 10. The pump 26 is also now ready for pumping liquid out of the tank 12 through the discharge nozzle 33 and the discharge hose 30 attached thereto. Accordingly, the switch 38 may be operated to its third position in order to supply power to the pump 26 so that liquid may be pumped from the tank 12 of the vacuum apparatus 10 through the discharge hose 30 to a discharge area, such as a drain or runoff, which is external to the vacuum apparatus 10.

When the pump 26 is seated in the pump receiving basin 86 and the pump 26 is pumping liquid out of the interior of the tank 12, the tank filter screen 80 and the inlet filter screen 98 filter larger objects from the liquid that enters through the socket neck 82 when the valve stem 62 has been disengaged from the valve seat 76 by the valve operator 28. Accordingly, liquid flows from the interior of the tank 12, through the tank filter screen 80, along the valve stem 62, through the socket neck 82, through the inlet filter screen 98, through the inlet aperture 110 in the inlet plate 96, and into the impeller 92. The impeller 92 drives this liquid through an opening (not shown) in the pump housing 88 and into the space between the pump motor 90 and the pump housing 88. The liquid in this space serves to cool the pump motor 90. From this space, the liquid flows out of the pump housing 88 through an opening (not shown) between the pump housing 88 and the pump housing cover 102, into the pump housing cover 102, through the discharge nozzle 33, and through the discharge hose 30 attached thereto.

When the pump 26 is removed from the docking station 42 in the tank 12, the pump 26 can be used as a stand alone pump in order to pump liquid from a wet area, which is external to the vacuum apparatus 10, to a discharge area, such as a drain or runoff area. Accordingly, when the pump 26 is used as a stand alone pump, liquid flows from the wet area, through the inlet filter screen 98, through the inlet aperture 110 in the inlet plate 96, and into the impeller 92. The inlet filter screen 98 filters solid and other material from the liquid that enters the impeller 92. The impeller 92 then drives the liquid through the discharge nozzle 33 and through the discharge hose 30 attached thereto.

Certain modifications of the present invention have been discussed above. Other modifications will occur to those practicing in the art of the present invention. For example, cooperating threads may be provided around the pump housing 88 and the circumferential docking wall 46 in order to assist in the attachment of the pump 26 to the tank 12. All such modifications are considered to be within the scope of the present invention as set out in the claims attached hereto.

What is claimed is:

1. A vacuum apparatus comprising:

holding means for holding material, the holding means having an opening, an interior, and an exterior;

drawing means for drawing the material from the exterior into the interior of the holding means; and, a docking station cooperating with the holding means to define a pump area in which a pump is received so that, when the pump is docked at the docking station, the pump may be used to pump material out of the holding means through the opening and the pump may be detached from the docking station.

2. The vacuum apparatus of claim 1 further comprising a valve having first and second positions, wherein the valve is arranged to cooperate with a valve seat of the docking station in order prevent communication between the pump area and the interior of the holding means when the valve is in its first position, and wherein the valve is arranged to permit communication between the pump area and the interior of the holding means when the valve is in its second position.

3. The vacuum apparatus of claim 2 wherein the valve includes a valve operator, and wherein the valve operator is accessible from the exterior of the holding means.

4. The vacuum apparatus of claim 3 wherein the valve includes a valve stem, and wherein the valve stem extends through the interior of the holding means from the valve operator to the valve seat.

5. The vacuum apparatus of claim 4 wherein the valve includes a filter surrounding the valve stem.

6. The vacuum apparatus of claim 4 wherein the docking station comprises a socket having a first end for receiving the pump and a second end extending through the opening of the holding means into the interior thereof.

7. The vacuum apparatus of claim 6 wherein the second end of the socket forms the valve seat.

8. The vacuum apparatus of claim 7 wherein the holding means has a recess, wherein the recess forms the pump area, and wherein the socket is in the recess.

9. The vacuum apparatus of claim 1 further comprising a valve stem and a valve operator, wherein the valve operator is accessible from the exterior of the holding means, wherein the valve operator is arranged to move the valve stem between first and second positions, wherein the valve stem extends through the interior of the holding means from the valve operator to the pump area, and wherein the valve stem is arranged to cooperate with a valve seat of the docking station in order to prevent communication between the pump area and the interior of the holding means when the valve stem is in its first position and to permit communication between the pump area and the interior of the holding means when the valve stem is in its second position.

10. The vacuum apparatus of claim 1 wherein the docking station comprises:

a socket having first and second ends, wherein the first end of the socket is arranged to receive the pump, and wherein the second end of the socket forms a valve seat; and, wherein the vacuum apparatus further comprises a valve stem and a valve operator, wherein the valve operator is accessible from the exterior of the holding means, wherein the valve operator is arranged to move the valve stem between first and second positions, wherein the valve stem extends through the interior of the holding means from the valve operator to the valve seat, and wherein the valve seat is arranged to cooperate with the valve stem to prevent communication between the pump area and the interior of the holding means when the valve stem is in its first position and to permit communication between the pump area and the interior of the holding means when the valve stem is in its second position.

11. A vacuum apparatus comprising:

a holding tank having an opening, an interior, and an exterior;

a source of vacuum arranged to draw material from the exterior into the interior of the holding tank; and, a submersible pump mounted to the exterior of the holding tank and arranged to discharge the material through the opening from the interior to the exterior of the holding tank.

12. The vacuum apparatus of claim 11 further comprising a valve having first and second positions, wherein the valve is arranged to prevent communication through the opening between the submersible pump and the interior of the holding tank when the valve is in its first position, and wherein the valve is arranged to permit communication through the opening between the submersible pump and the interior of the holding tank when the valve is in its second position.

13. The vacuum apparatus of claim 12 wherein the valve includes a valve operator, and wherein the valve operator is accessible from the exterior of the holding tank.

14. The vacuum apparatus of claim 13 wherein the valve includes a valve stem, and wherein the valve stem extends through the interior of the holding tank from the valve operator to the submersible pump.

15. The vacuum apparatus of claim 14 wherein the valve includes a filter surrounding the valve stem.

16. The vacuum apparatus of claim 14 further comprising a socket having a first end for receiving the submersible pump and a second end extending through the opening of the holding tank into the interior thereof.

17. The vacuum apparatus of claim 16 wherein the second end of the socket forms a valve seat, and wherein the valve seat is arranged to cooperate with the valve stem to prevent communication between the submersible pump and the interior of the holding tank when the valve is in its first position and to permit communication between the submersible pump and the interior of the holding tank when the valve is in its second position.

18. The vacuum apparatus of claim 17 wherein the submersible pump comprises a pump housing and a seal, and wherein the seal cooperates with the socket and the pump housing when the submersible pump is mounted to the holding tank so that the material is prevented from leaking out around the pump housing when the valve is in its second position.

19. The vacuum apparatus of claim 18 wherein the holding tank has a recess, and wherein the socket is in the recess.

20. The vacuum apparatus of claim 19 wherein the pump housing and the recess of the holding tank are dimensioned so as to provide a friction fit between the pump housing and the holding tank, and wherein the friction fit is arranged to hold the submersible pump to the holding tank.

21. The vacuum apparatus of claim 20 wherein the pump housing has a handle, wherein the recess has a groove, and wherein the handle of the pump housing and the groove of the recess cooperate to hold the pump to the holding tank.

22. The vacuum apparatus of claim 11 wherein the submersible pump includes a pump housing, wherein the holding tank has a recess, wherein the pump housing and the recess of the holding tank are dimensioned so as to provide a friction fit between the pump housing and the holding tank, and wherein the friction fit is arranged to hold the submersible pump to the holding tank.

23. The vacuum apparatus of claim 22 wherein the pump housing has a handle, wherein the recess of the holding tank has a groove, and wherein the handle of the pump housing and the groove of the recess cooperate to hold the submersible pump to the holding tank.

24. The vacuum apparatus of claim 11 further comprising a valve stem and a valve operator, wherein the valve operator is accessible from the exterior of the holding tank, wherein the valve operator is arranged to move the valve stem between first and second positions, wherein the valve stem extends through the interior of the holding the valve operator to the submersible pump, and wherein the valve stem is arranged to prevent communication through the opening between the submersible pump and the interior of the holding tank when the valve stem is in its first position and to permit communication through the opening between the submersible pump and the interior of the holding tank when the valve stem is in its second position.

25. The vacuum apparatus of claim 11 further comprising:

a socket affixed to the holding tank, wherein the socket has first and second ends, wherein the first end of the socket is arranged to receive the submersible pump, and wherein the second end of the socket forms a valve seat; and, a valve stem and a valve operator, wherein the valve operator is accessible from the exterior of the holding tank, wherein the valve operator is arranged to move the valve stem between first and second positions, wherein the valve stem extends through the interior of the holding tank from the valve operator to the valve seat, and wherein the valve seat is arranged to cooperate with the valve stem to prevent communication between the submersible pump and the interior of the holding tank when the valve stem is in its first position and to permit communication between the submersible pump and the interior of the holding tank when the valve stem is in its second position.

26. A vacuum apparatus comprising:

a holding tank having an opening, an interior, and an exterior;

a source of vacuum arranged to draw material from the exterior into the interior of the holding tank; and, a pump mounted with a quick connect to the holding tank and arranged to discharge the material from the interior through the opening to the exterior of the holding tank.

27. The vacuum apparatus of claim 26 further comprising a valve having first and second positions, wherein the valve is arranged to prevent communication through the opening between the pump and the interior of the holding tank when the valve is in its first position, and wherein the valve is arranged to permit communication through the opening between the pump and the interior of the holding tank when the valve is in its second position.

28. The vacuum apparatus of claim 27 wherein the valve includes a valve operator, and wherein the valve operator is accessible from the exterior of the holding tank.

29. The vacuum apparatus of claim 28 wherein the valve includes a valve stem, and wherein the valve stem extends through the interior of the holding tank from the valve operator to the pump.

30. The vacuum apparatus of claim 29 wherein the valve includes a filter surrounding the valve stem.

31. The vacuum apparatus of claim 29 further comprising a socket having a first end for receiving the pump and a second end extending through the opening of the holding tank into the interior thereof.

32. The vacuum apparatus of claim 31 wherein the second end of the socket forms a valve seat, and wherein the valve seat is arranged to cooperate with the valve stem to prevent communication between the pump and the interior of the holding tank when the valve is in its first position and to permit communication between the pump and the interior of the holding tank when the valve is in its second position.

33. The vacuum apparatus of claim 32 wherein the pump comprises a pump housing and a seal, and wherein the seal cooperates with the socket and the pump housing when the pump is mounted to the holding tank so that the material is prevented from leaking out around the pump housing when the valve is in its second position.

34. The vacuum apparatus of claim 33 wherein the holding tank has a recess, and wherein the socket is in the recess.

35. The vacuum apparatus of claim 34 wherein the pump housing and the recess of the holding tank are dimensioned so as to provide a friction fit between the pump housing and the holding tank, and wherein the friction fit between the pump housing and the holding tank is arranged to hold the pump to the holding tank.

36. The vacuum apparatus of claim 35 wherein the pump housing has a handle, wherein the recess has a groove, and wherein the handle of the pump housing and the groove of the recess cooperate to hold the pumping means to the holding tank.

37. The vacuum apparatus of claim 26 wherein the pump includes a pump housing, wherein the holding tank has a recess, wherein the pump housing and the recess of the holding tank are dimensioned so as to provide a friction fit between the pump housing and the holding tank, and wherein the friction fit between the pump housing and the holding tank is arranged to hold the pump to the holding tank.

38. The vacuum apparatus of claim 37 wherein the pump housing has a handle, wherein the recess of the holding tank has a groove, and wherein the handle of the pump housing and the groove of the recess cooperate to hold the pump to the holding tank.

39. The vacuum apparatus of claim 26 further comprising a valve stem and a valve operator, wherein the valve operator is accessible from the exterior of the holding tank, wherein the valve operator is arranged to move the valve stem between first and second positions, wherein the valve stem extends through the interior of the holding tank from the valve operator to the pump, and wherein the valve stem is arranged to prevent communication through the opening between the pump and the interior of the holding tank when the valve stem is in its first position and to permit communication through the opening between the pump and the interior of the holding tank when the valve stem is in its second position.

40. The vacuum apparatus of claim 26 further comprising:

a socket affixed to the holding tank, wherein the socket has first and second ends, wherein the first end of the socket is arranged to receive the pump, and wherein the second end of the socket forms a valve seat; and, a valve stem and a valve operator, wherein the valve operator is accessible from the exterior of the holding tank, wherein the valve operator is arranged to move the valve stem between first and second positions, wherein the valve stem extends through the interior of the holding tank from the valve operator to the valve seat, and wherein the valve seat is arranged to cooperate with the valve stem to prevent communication between the pump and the interior of the holding tank when the valve stem is in its first position and to permit communication between the pump and the interior of the holding tank when the valve stem is in its second position.

41. The vacuum apparatus of claim 26 wherein the pump has a handle, wherein the holding tank has a groove, and wherein the handle of the pump and the groove of the holding tank cooperate to hold the pump to the holding tank.

42. The vacuum apparatus of claim 26 further comprising switching means for switching power to and from the source of vacuum and the pump, wherein the switching means has a first position in which the switching means cuts off power to the source of vacuum and the pump, wherein the switching means has a second position in which the switching means switches power to the source of vacuum, and wherein the switching means has a third, momentary position in which the switching means switches power to the pump for only so long as an operator manually operates the switching means.

* * * * *